US005845522A

United States Patent [19]

Shen

[11] Patent Number: 5,845,522

[45] Date of Patent: Dec. 8, 1998

[54] FASTENING ARRANGEMENT FOR A CYLINDRICAL LOCK

[76] Inventor: Mu-Lin Shen, No. 32, Lane 76, Sec. 5, Fu-An Rd., Tainan, Taiwan

[21] Appl. No.: 813,190

[22] Filed: Mar. 10, 1997

[51] Int. Cl.[6] ..... E05B 9/08

[52] U.S. Cl. ..... 70/224; 70/370; 70/451; 70/452; 292/356; 292/357; 292/DIG. 53; 292/DIG. 64

[58] Field of Search ..... 295/356, 357, 295/337, 336.3, DIG. 53, DIG. 64; 70/224, 370, 451, 452, 449, 417, 381

[56] References Cited

U.S. PATENT DOCUMENTS

| | | | |
|---|---|---|---|
| 186,194 | 1/1877 | Barlow | 292/357 |
| 1,316,178 | 9/1919 | Page | 70/452 |
| 2,117,715 | 5/1938 | Godfried | 70/417 |
| 2,238,314 | 4/1941 | Falk | 70/451 |
| 2,779,184 | 1/1957 | Ellis | 292/357 |
| 2,795,948 | 6/1957 | Rayburn | 292/357 |
| 3,550,411 | 12/1970 | Neary et al. | 70/370 |
| 3,955,387 | 5/1976 | Best et al. | 292/336.3 X |
| 4,073,172 | 2/1978 | Schlage | 70/370 X |
| 4,236,396 | 12/1980 | Surko, Jr. et al. | 292/357 X |
| 4,428,212 | 1/1984 | Best et al. | 292/336.5 X |
| 4,869,083 | 9/1989 | DeMarseilles et al. | 70/224 |
| 4,921,289 | 5/1990 | Shen | 292/336.3 |
| 5,141,269 | 8/1992 | Haq et al. | 292/169 |
| 5,149,155 | 9/1992 | Caeti et al. | 292/357 X |
| 5,335,950 | 8/1994 | Mirshafiee et al. | 292/356 |
| 5,590,555 | 1/1997 | Kester et al. | 292/357 X |
| 5,605,064 | 2/1997 | Katayama et al. | 70/224 |

*Primary Examiner*—Lloyd A. Gall
*Attorney, Agent, or Firm*—Burns, Doane, Swecker & Mathis, L.L.P.

[57] ABSTRACT

A fastening device used with a lock for firmly securing the lock in position against undesired rotational movement with respect to a door where the lock is mounted. The fastening device comprises a pair of mounting screws for firmly securing an inside and an outside escutcheon to the door and a pair of fastening screws extending through a main lock assembly to firmly support it with respect to the outside escutcheon of the already firmly secured inside and outside escutcheons assembly.

2 Claims, 3 Drawing Sheets

FASTENING ARRANGEMENT FOR A CYLINDRICAL LOCK

BACKGROUND OF THE INVENTION

The present invention relates to a fastening device used in a cylindrical lock for firmly connecting stationary components of the lock together and for securely anchoring the firmly connected stationary components to the door so as to ensure proper operation of the lock.

A cylindrical lock has stationary components for firmly anchoring and supporting the lock to a door. Generally, the stationary components include a generally C-shaped frame, first and second spindle housings or hubs secured to the frame, and rose plates mounted to the door and supporting the first and second spindle housings or hubs. In the situation that the support provided by these stationary components is firm and stable, movable components of the lock, e.g. sleeve with roll-back cam, can properly perform their intended functions. On the contrary, if the interconnection between the stationary components and the door is not firm, movable components may not properly perform their intended functions due to, for example, obstruction, misalignment, etc. Even worse, engagement between the retractor and the tailpiece of a latch bolt assembly may be disrupted. This is especially so for long handles and associated heavy-duty torsion springs.

Moreover, in locks where an outside knob or handle may be locked against rotation by manipulating a turn button situated on the side opposite to the knob or handle (i.e., on the inside of the door), turning the knob or handle when it is in an operative or locked position may apply a torque to the spindle housing or hub due to the locking relationship between the knob sleeve and the hub. The outer or outside hub is thus frequently subject to a torque and, if not securely supported or fixed, undesired movement thereof is likely.

U.S. Pat. No. 4,921,289 issued to Shen on May 1, 1990 discloses a cylindrical lever type lock which comprises a pair of plates each having cutouts and triangular protrusions for securely mounting on opposite sides of the door in order to firmly support first and second spindle housings in position. To permit mounting of the first and second spindle housings on the door by the pair of plates, a pair of protrusions are oppositely formed on each plate and corresponding grooves with flat bottoms are disposed at each of the first and second spindle housings so that the pair of protrusions may cross or slide over the flat grooves during mounting.

U.S. Pat. No. 4,428,212 issued to Best et al. on Jan. 31, 1984 discloses a cylinder lock retractor and chassis assembly. In this prior patent, it can be seen that face assembly end plates carry a dogging pin adapted to enter one of a circumferential series of holes to secure an outer rose assembly in a properly adjusted position to suitably locate the cylinder lock in the door in alignment with the latch bolt assembly. There is no suggestion in this prior patent that the dogging pin can be used to fasten any elements together. Moreover, even if the dogging pin is to be used for purposes of fastening several elements together, the arrangement of the rose assembly or the inside mounting plate of the outer rose assembly, to which the dogging pin finally is engaged, on the door is still not secure or firm. This is so because a relative sliding movement of the inside mounting plate over the door, particularly by turning the knob or handle when in an operative or locked position, the turning action then being transmitted via the hub and the end plate to the dogging pin and the rose assembly, is possible.

U.S. Pat. No. 3,955,387 issued to Best et al. on May 11, 1976 discloses a cylindrical lock set. Here, like the construction for the above-mentioned U.S. Pat. No. 4,428,212, a locking pin is provided. The locking pin fixes an outer escutcheon assembly which is axially adjustable along hubs as needed to suit the door thickness, and to position the chassis of the lock set centrally with the door and in alignment of the bolt assembly. In addition, clamp screws are provided for clamping a clamp plate to the chassis and are threaded into hollow clamp studs. The retractor frame has two laterally projecting ears that are received in notches of the side plates. Again, a relative sliding movement between the clamp plate over the door is possible. Also, the provision of the clamp screws does not contribute to clamping of the outer escutcheon assembly simply because it is associated with the clamp plate situated at the inside escutcheon assembly.

SUMMARY OF THE INVENTION

One object of the present invention is to provide a fastening device for a cylindrical lock of the type having a chassis which slidably receives a retractor in engagement with a latch bolt assembly, an inside hub and an outside hub, an inside knob sleeve and an outside knob sleeve operable to rotate with respect to the inside and the outside hubs, an inside escutcheon and an outside escutcheon supporting the lock and means for immobilizing the outside knob sleeve with respect to the outside hub, the fastening device comprising: means for anchoring the inside and outside escutcheons to a door against rotational movement; and a pair of fastening screws each extending through the inside hub, the chassis, the outer hub and the outside escutcheon. With such a construction, the lock can be suitably supported in position against any undesired rotational movement, especially that movement caused by the outside hub.

Preferably, the means for anchoring comprises a pair of studs each extending from the outside escutcheon into a respective through-hole provided on the door, a respective hole formed on the inside escutcheon and aligned with a corresponding through-hole, and a pair of mounting screws each extending through corresponding hole, through-hole and stud to firmly securing the inside and outside escutcheons to the door.

Preferably, a respective screw hole is formed on the outside hub for threaded engagement of a corresponding one of the pair of fastening screws so as to firmly secure the inside hub and outside hub and the chassis together.

Other objects, advantages and novel features of the invention will become more apparent from the following detailed description when taken in conjunction with the accompanying drawings.

DETAILED DESCRIPTION OF THE INVENTION

Figure 1:
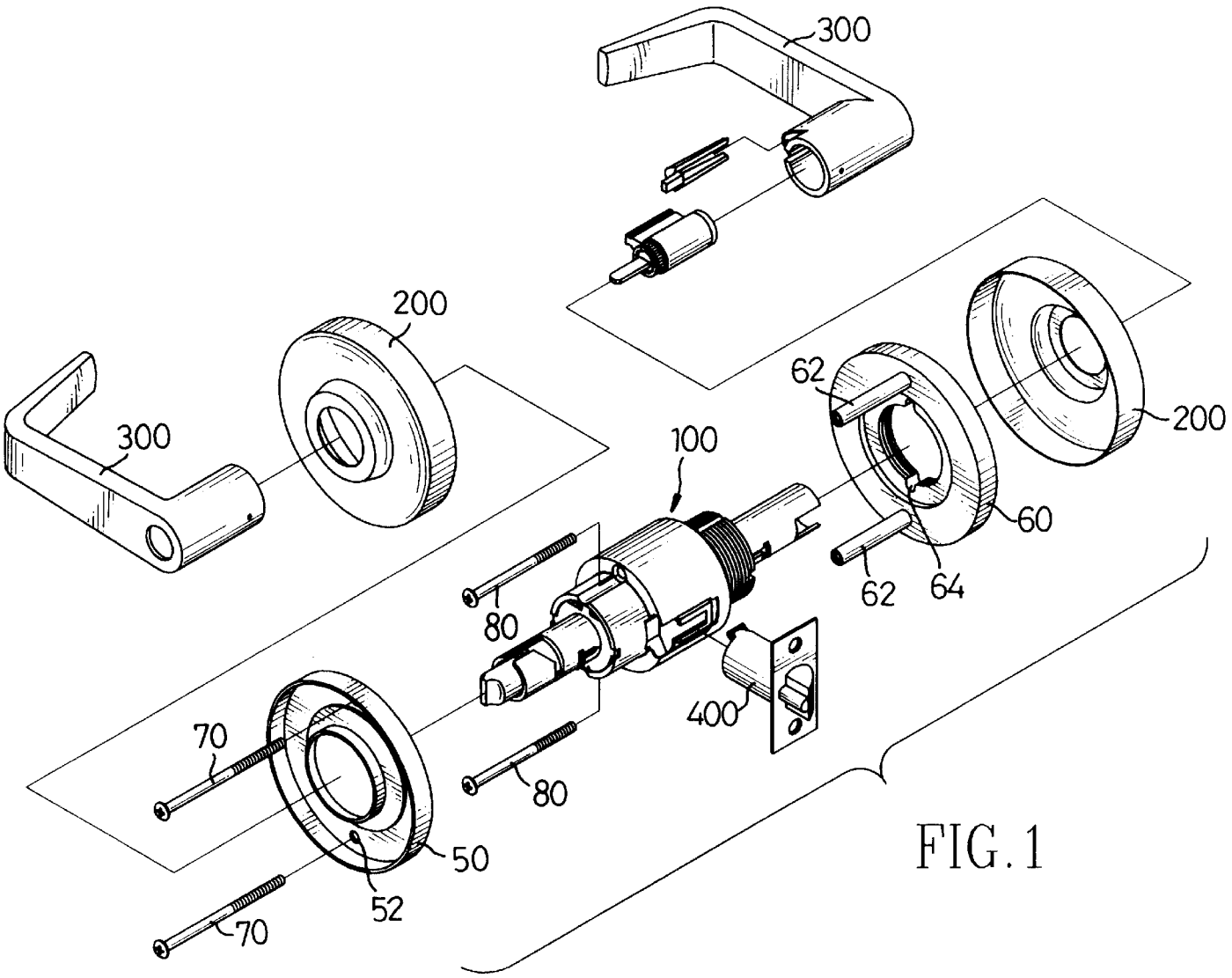
FIG. 1 is a perspective exploded view of a cylindrical lock and a fastening device used therefor in accordance with the present invention.
Figure 2:
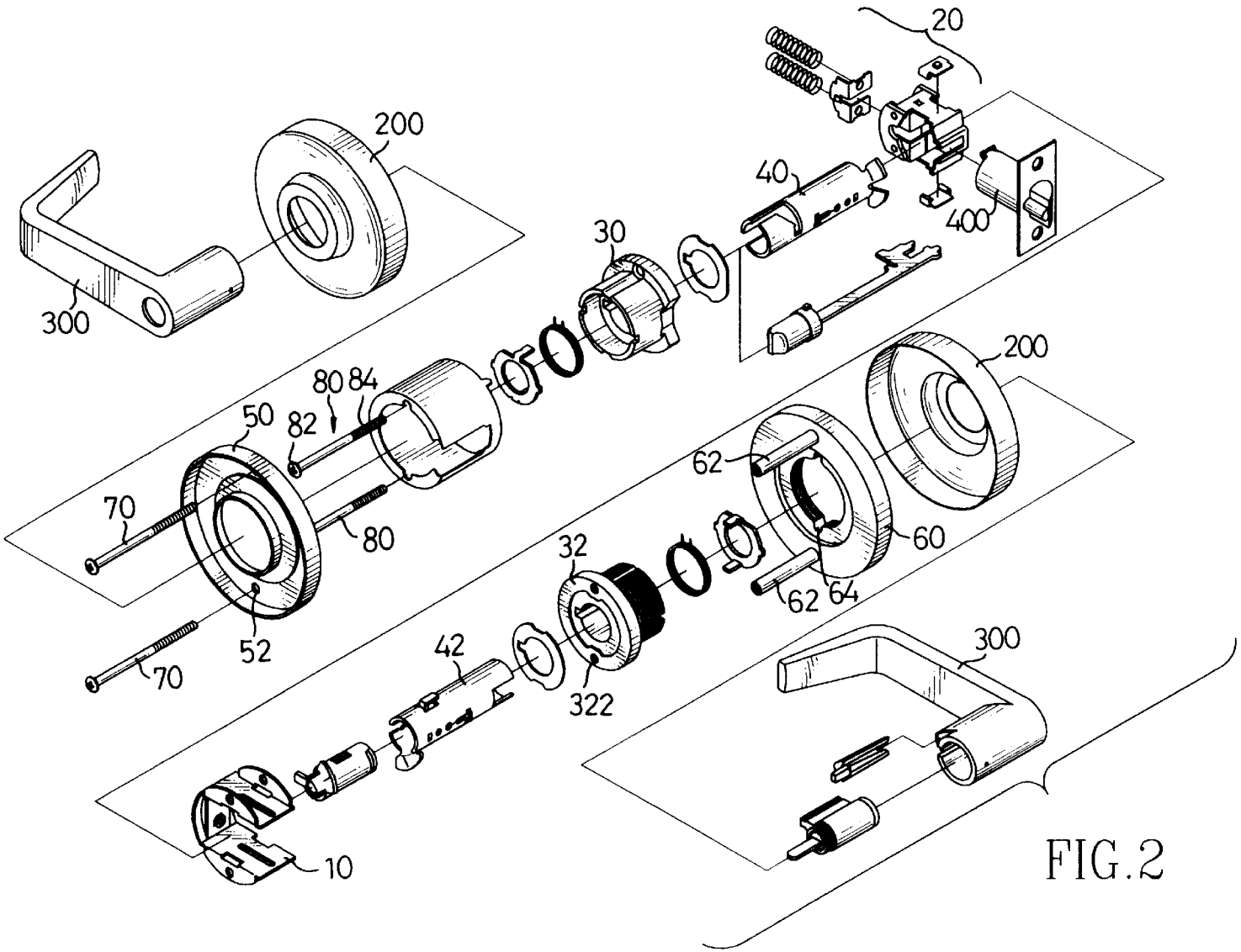
FIG. 2 is a detailed exploded view of the cylindrical lock and the fastening device used therefor shown in FIG. 1.

Referring to the drawing figures and initially to FIGS. 1 and 2, there is shown a cylindrical lock and a fastening device used for the lock. The lock generally comprises a main lock assembly 100 and peripherals such as decorative inside and outside escutcheon facings 200, inside and outside handles 300, a latch bolt assembly 400, etc., which cooperate with the main lock assembly 100 in a generally known manner. The main lock assembly 100 comprises a chassis 10 which slidably receives a retractor 20 in operational engagement with the latch bolt assembly 400 in a known manner, an inside and an outside hub 30 and 32, an inside and an outside knob sleeve 40 and 42 operable to rotate respectively within the inside and the outside hubs 30 and 32, an inside escutcheon 50 and an outside escutcheon 60 used for supporting the main lock assembly 100, and means for immobilizing the outside knob sleeve 42 with respect to the outside hub 32. The means for immobilizing involves the previously mentioned function available in locks where an outer or outside knob or handle may be locked against rotation by manipulating a turn button situated at a side opposite to the knob or handle (i.e., on the inside of the door). This feature can be implemented by any suitable known mechanism, and has no direct connection with the present invention, therefor a detailed description is believed unnecessary.

Figure 3:
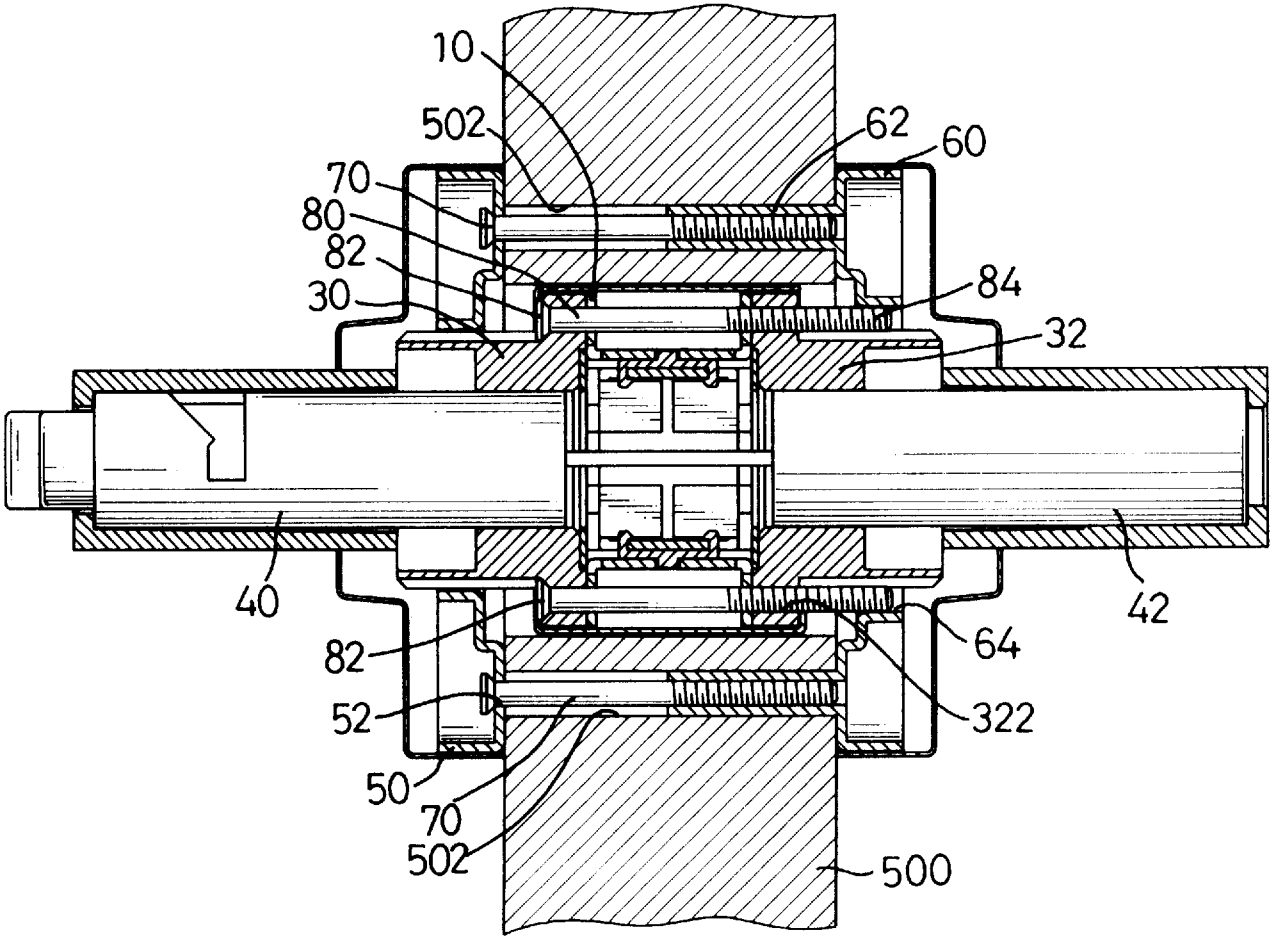
FIG. 3 is a cross-sectional view showing the cylindrical lock and the fastening device used therefor shown in FIG. 1 mounted to a door.

A description for the fastening device of the present invention as used in the above-described type of lock will now be given below by reference also to FIG. 3.

The fastening device comprises: a pair of studs 62 each extending from the outside escutcheon 60 into a respective through-hole 502 provided in a door 500, a respective hole 52 formed on the inside escutcheon 50 and aligned with a corresponding through-hole 502, a pair of mounting screws 70 each extending through corresponding hole 52, through-hole 502 and stud 62 to firmly securing the inside and outside escutcheons 50 and 60 to the door 500, and a pair of fastening screws 80 each extending sequentially through the inside hub 30, the chassis 10, the outer hub 32 and the outside escutcheon 60.

It is noted that a respective screw hole 322 is formed on the outside hub 32 for threaded engagement of a corresponding one of the pair of fastening screws 80. The fastening screw 80 has a wide head 82 on one end and a threaded portion 84 on the other end. The fastening screw 80 can screw in the screw hole 322 of the outside hub 32, with the wide head 82 pressing both the inside hub 30 and the chassis 10 against the outside hub 32, thereby firmly securing the inside and outside hubs 30 and 32 and the chassis 10 together.

Each fastening screw 80 has such a length that it extends into a corresponding notch 64 of the outside escutcheon 60. Due to provision of the fastening screws 80 linking the several components through which it passes to the outside escutcheon 60, the main lock assembly 100 can be stably supported in position against any undesired rotational movement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cylindrical lock having a chassis which slidably receives a retractor in engagement with a latch bolt assembly, an inside and an outside hub, an inside and an outside knob sleeve operable to rotate with respect to the inside and the outside hub, an inside escutcheon and outside escutcheon supporting the lock, and a fastening arrangement, the fastening arrangement comprising:

a plurality of studs extending from one of the outside escutcheon and the inside escutcheon, each of the studs adapted to extend into a respective through-hole provided in a door;

a plurality of holes defined in the other of the outside escutcheon and the inside escutcheon, each hole is adapted to be aligned with one of the corresponding through-holes;

a plurality of mounting screws each extending through a corresponding one of the holes, adapted to extend through a corresponding one of the through-holes, and extending through a corresponding one of the studs to firmly secure the inside and outside escutcheon to the door; and a plurality of fastening screws each extending through the inside hub, the chassis, the outside hub, and into the outside escutcheon.

2. The cylindrical lock of claim 1, wherein a respective screw hole is defined in the outside hub for threaded engagement with a corresponding one of the plurality of fastening screws.

* * * * *